United States Patent [19]

Richardson

[11] Patent Number: 4,914,860

[45] Date of Patent: Apr. 10, 1990

[54] FLOWER POT COVER

[76] Inventor: Michael-Anne Richardson, 53 Bluestone Drive, Nashva, N.H. 03060

[21] Appl. No.: 161,030

[22] Filed: Feb. 26, 1988

[51] Int. Cl.[4] ..... A47G 7/00

[52] U.S. Cl. ..... 47/72; 47/67; D11/143

[58] Field of Search ..... 47/54, 72, 66, 67, 33; D5/26; D11/143, 144; 206/457, 458; 150/52 R; 229/87 P

[56] References Cited

U.S. PATENT DOCUMENTS

| | | | |
|---|---|---|---|
| 229,653 | 12/1973 | Hendrickson | 150/52 R X |
| 767,175 | 8/1904 | Sibole | 47/72 |
| 2,152,648 | 4/1939 | Jones | 150/52 R |
| 2,209,778 | 7/1940 | Krasowski | 47/72 |
| 2,302,259 | 11/1942 | Rothfuss | 47/72 |
| 2,355,559 | 8/1944 | Renner | 47/72 |
| 2,440,569 | 4/1948 | Baldwin | 47/72 |
| 2,884,741 | 5/1959 | Lange | 47/72 |
| 4,300,312 | 11/1981 | Weder et al. | 47/72 |
| 4,644,686 | 2/1987 | Whitman | 47/72 X |

FOREIGN PATENT DOCUMENTS

| | | | |
|---|---|---|---|
| 2093408 | 9/1982 | United Kingdom | 47/66 |

OTHER PUBLICATIONS

"Attractive Containers to Display Houseplants", Good Housekeeping, pp. 128, Mar. 1975.

"Plant Pants" sales brochure, Originals by Michael-Anne, 1985, photographs included.

*Primary Examiner*—Randolph A. Reese
*Assistant Examiner*—Jeffrey L. Thompson
*Attorney, Agent, or Firm*—Robert A. Seemann

[57] ABSTRACT

A pocket having an opening at the top for the flower pot consists of an inner layer of flexible waterproof material, and an outer layer of a flexible material, the outer layer in the area of the pocket being in the form of the trunk of an animal, the outer layer extending in the form of a body extremity from the pocket area, and being filled with a cushioning material so that it is a semi rigid cushioned protuberance. A removable item of apparel may be attached to the protuberance.

2 Claims, 3 Drawing Sheets

FLOWER POT COVER

BACKGROUND OF THE INVENTION

1. Field of the Invention

This invention relates to plant receptacles, more particularly to a decorative cover for flower pots. Especially for the variety of pots which are hung indoors.

2. Description of the Prior Art

A flower pot of clay or plastic is unattractive to look at. Resting on table or stand, in a saucer type receptacle for drainage, the pot detracts from the beauty of the plant which it holds. Hanging from a ceiling, receptacle and all, it can be even less inviting to the eye. The pot is usually hung away from high traffic areas, but painful collisions by head and limb often occur.

The prior art abounds with devices for improving the visual aspect of the resting or hanging plant pot. This includes the pot itself in decorative shape and color, a decorative stand or hanging cage with recess for retaining the pot out of sight, and a decorative cover for the pot.

A decorative pot costs several times that of the simple clay or plastic type.

A stand or hanging cage takes more space than a decorative pot, costs several times more, and usually limits to a maximum pot size.

Each of the two above options serves its purpose well, until the plant outgrows it, or the owner grows tired of its appearance. Then a high replacement cost becomes necessary.

One simple and relatively economical way to way to decorate and change to a new design or size is through use of a cover for the pot. One such cover is described in U.S. Pat. No. 2,209,778, awarded to J. Krasowski on July 30, 1940.

Krasowski provides a decorative covering for a flower pot and its support, the support generally consisting of an ordinary kitchen saucer. The covering comprises a sheet of flexible material such as fabric, rubberized or oiled silk or similar material. The fabric can be the same as that used in the drapes or bedspread of the room in which the plant will reside. The sheet includes three stitched-in longitudinal pockets running across it from left to right, for holding three elastic binding strips, one upper binding strip located somewhat below the top margin of the sheet, an intermediate binding strip located near the bottom margin, and a lower binding strip comprising the bottom margin of the sheet. A plurality of hook-shaped members are secured to the sheet below but near the upper margin. The left and right edges of the sheet include hooks and eyes, or other fastener means, so that the sheet can be removably fastened into a tube, with the hooks directed inward and downward within. The three elastic binding strips are so located that, when the sheet is wrapped and fastened around the pot, the upper strip seats around the top collar of the flower pot, the intermediate strip rests against the lower end of the body of the pot above the saucer, and the lower strip engages beneath the sides of the support saucer, so that when the pot is lifted from a table or other supporting surface, the cover retains the support saucer, preventing accidental separation of the saucer from the pot. The hook-shaped members detachably engage the rim of the flower pot so that the top of the cover extends a predetermined distance above the peripheral rim of the flower pot, and cannot slip down.

Another cover invention is described in U.S. Pat. No. 2,355,559, awarded on Aug. 8, 1944 to F. Renner. The invention provides a cover for containers such as flower pots, vases, bowls and casseroles. It is molded in the form of the outer surface of the container by pressing individual sheets of heat-sealable, moisture proof material arranged in an overlapping manner, in heated dies. The sheet material may be inherently heat-sealable such as with films formed of synthetic resins or halogenated rubber, or may be coated with heat-sealable materials. Those materials which are not moisture proof may be treated so that they become both heat-sealable and moisture proof. The material may be transparent and metallic films of aluminum, tin and lead alloys may also be used.

Contributing to strength and rigidity, the sheets forming the sidewalls are pressed into overlapping vertically oriented folds and become heat-sealed between the folds as well as between themselves by the heated dies. Arcuate ridges may also be formed in the cover in the manner of spaced, stacked rings, to provide lateral rigidity and elastic extensibility in the vertical direction to better grip the container around the outer wall.

The cover encloses the bottom of the pot so that a drainage hole in the pot bottom will not leak water onto a supporting surface. The top of the cover may extend away from the pot in the nature of a ruffled skirt.

Preferably, the cover is molded with several layers, the outer layer being transparent to permit view of colors or advertising data residing in layers below.

In another invention, described in U.S. Pat. No. 2,440,569 patented April 27, 1948 by F. Baldwin, a cover for flower pots is made from waterproof and elastic or stretchable material such as rubber latex, synthetic rubber, synthetic resin, or vinyl acetate, whereby it will stretch to accurately conform to the exterior of pots of various sizes and designs. The bottom of the cover has an opening that is in alignment with the drain hole in the flower pot, and may also include reinforcement by way of a rubber disc having an opening that is also in alignment with the drain hole. Although the cover is smaller than the pot it will stretch to the external formation of the pot, it is also higher than the pot so that it will flair inward over the top rim of the pot owing to absence there of resistance to the elastic force.

A cover made from rigid or semi flexible material such as a metal or plastic, is described in U.S. Pat. No. 2,884,741 awarded to R. Lange on May 5, 1959. It includes a conical section that is larger at the top where a circular flange extends laterally, and with a bottom that is sealed. Extending upwardly from the flange is a circular upper rim portion.

The cover sidewall is higher than the inserted pot, and is dimensioned to be slightly larger than the pot to allow insertion and removal and to permit evaporation of water from the pot wall. The top edge of the cover is beaded or flanged outwardly from the upper rim portion to add rigidity to the top edge.

Upwardly projecting nipples or similar supports are located on the bottom of the cover to support the pot, leaving reservoir space between the bottom of the pot and the cover to receive excess water from the pot.

Vertically oriented channels are included in the wall of the conical section to vent the cover, let air around the pot, and facilitate evaporation of water in the reservoir.

The afore described inventions provide a slip-on waterproof cover which keeps a wet and stained pot surface from view while, but for frills and pleats, the wall of the cover mimics the shape of the pot.

It is one object of the present invention to provide a cover for a flower pot which conceals the pot.

Another object of the invention is to provide a flower pot cover for hanging pots which cushions against impact from a foreign object, reducing chance of injury to both the pot and the object.

Another object of the invention is to provide a flower pot cover which partially disguises the shape of the pot.

Still another object of the invention is to provide a flower pot cover which has a cushioned, decorative shape that is independent of the shape of the pot.

Yet another object is to provide a flower pot cover which includes cushioned protrusions in a decorative shape.

Another object is to provide a flower pot cover which includes cushioned protrusions in a decorative shape mimicking the shape of an animal.

Another object is to provide a flower pot cover which includes cushioned protrusions in a decorative shape mimicking the shape of an animal, the animal including a removable item of apparel.

Another object is to provide a flower pot cover having a waterproof inner layer and a water permeable outer cover having portions of itself spaced from the inner layer, in which the outer layer further includes cushioned protrusions in a decorative shape.

Another object is to provide a cover including many of the above objects, that is relatively inexpensive and quick and easy to install or remove from a flower pot.

Other objects and advantages will become apparent from a reading of the ensuing drawings and description.

In accordance with the invention, there is provided a flower pot cover having an inner layer and an outer layer, both layers comprising flexible materials. The inner layer forms a pocket for receiving the flower pot through a top opening, the pocket further including a bottom that is sealed against water leakage from within the cover.

The outer layer has a protuberance that includes material which cushions against impact. The protuberance comprises a decorative form of a first recognizable object, such as an animal or an occupied article of clothing. For further entertainment of the observer, the protuberance includes a removably attached second recognizable object. One example of a removably attached second recognizable object is a removable item of apparel for a first recognizable animal type object.

The top opening of the pocket is reducible for securing the cover on the pot. In one embodiment, for example, the opening includes a string tie for constricting the opening about the pot.

In a preferred embodiment, the opening includes an elastic gather, and the pocket is high enough so that the gather constricts over the top of the pot for hanging the cover from the pot.

In a preferred embodiment, the protuberance comprises a semi rigid closed cell of cushioning material. The cell may be constructed, for example, by enclosing shock absorbing or cushioning material within a fold of the outer layer that is cut to a recognizable part of an animal, and stitching around the fold to form a tightly packed, semi rigid protuberance, so that it extends horizontally from the second layer.

In another embodiment, the protuberance comprises a shock absorbing foam animal part that is joined to the outer layer.

In another embodiment, the protuberance comprises an occupied article of clothing, such as a pair of pants with feet, in which the flower pot takes the place of the lower trunk of the body. Shock absorbing cushioning surrounds the pot and fills the pants legs and feet.

In order to minimize cause for mold, the outer layer comprises a water permeable material and is shaped to have portions of itself spaced from the inner layer. This reduces moisture between the inner and outer layer by drying.

DESCRIPTION OF THE PREFERRED EMBODIMENTS

Before explaining the invention in detail, it is to be understood that the phraseology and terminology employed is for the purpose of description only and not of limitation.

Figure 1:
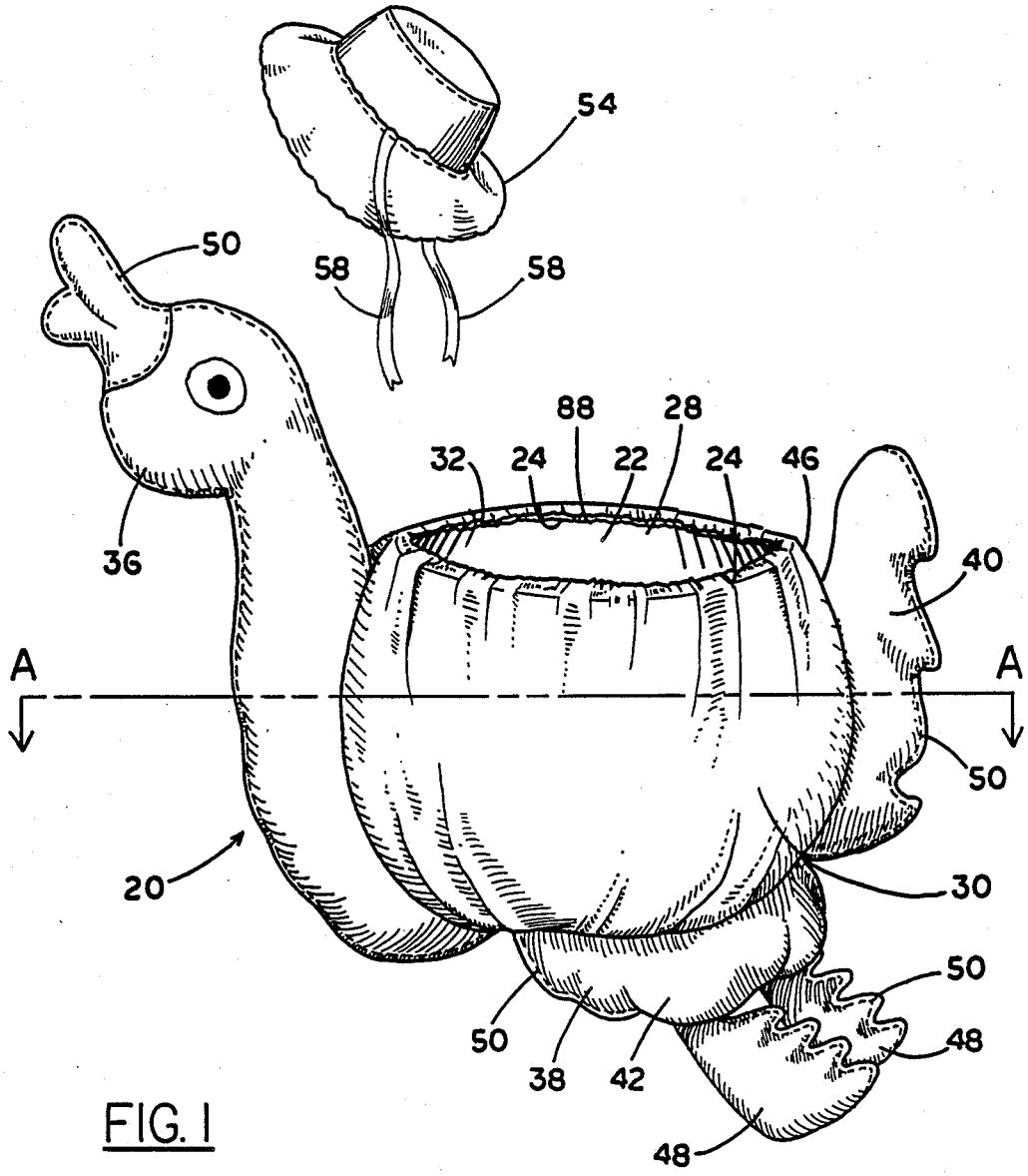
FIG. 1 is a front perspective view of a preferred embodiment of the invention.

Referring to the drawings in which like components are designated by like reference throughout the various figures, FIG. 1, shows a flower pot cover according to a preferred embodiment of the invention.

In FIG. 1, flower pot cover 20, enclosing flower pot 22, hangs from the flower pot upper rim 24, by overwrap of top 28 of pocket 30 of the flower cover 20. Elastic (not shown), sewn in top opening end of the pocket, reduces the size of the opening so that it is constricted over the top of the pot when the pot is installed in the pocket.

Protuberance 36 has a decorative recognizable form of the head of a duck for the entertainment of a viewer. It includes material such as (not shown) cotton batting or foam rubber which has resistance to impact.

Protuberance 36 is semirigid so that it extends horizontally from outer layer 46 of cover 20.

Protuberance 38 has a decorative recognizable form of the thigh 42 and legs 48 of a duck. The stylized thigh 42 includes material (not shown) for resistance to impact. The thigh and legs are semirigid so that the legs extend in a horizontal laterally from the cover.

Protuberance 40, in the likeness of a tail, also includes material (not shown) for resistance to impact, and is semirigid so that it extends horizontally from the cover.

Protuberances 36 and 40 are cellular in construction, each formed from a fold of outer layer 46 that is cut so that when the layer is folded over impact resistant cushioning material and stitched 50 around where the cut edges meet, a semirigid cushioned cell is formed.

Thigh 42 of protuberance 38 is formed from a separate piece of material which is cut to pattern, folded over impact resistant cushioning material and sewn around. It is attached to the cover by stitching. Legs 48 of protuberance 38, likewise are made from separate pieces of shaped material, folded over cushioning material and stitched. Although they can be made by folding the outer layer, making the thigh and legs from separate material permits them to be of different color and texture from the rest of the cover.

In addition to a viewer being entertained by the cover that is in form of a duck, removable hat 54, fastened on protuberance 36 by ribbons 58, further adds to the viewer's delight, and the hat may be changed to complement the change in plant flowering.

Figure 2:
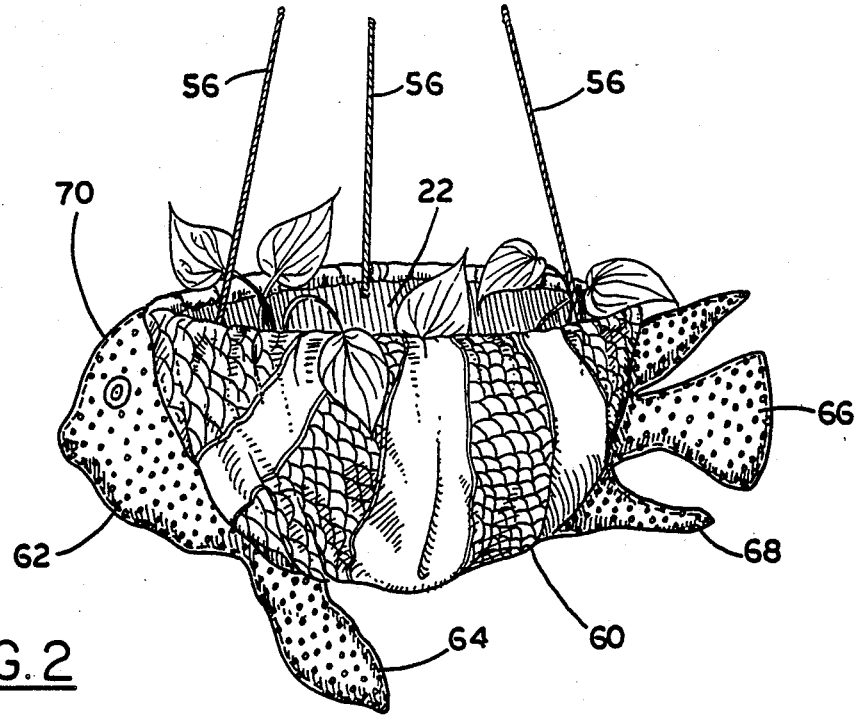
FIG. 2 is a front perspective view of a hanging pot with flower pot cover.

FIG. 2 shows another embodiment of the invention in which the flower pot cover presents the stylized form and visage of a fish. Flower pot 22 hangs from ropes 56 from a ceiling (not shown). Flower pot cover 60 includes impact cushioning cells protuberances 62, 64 and 66 and 68 which are formed as various parts of the fish.

Figure 3:
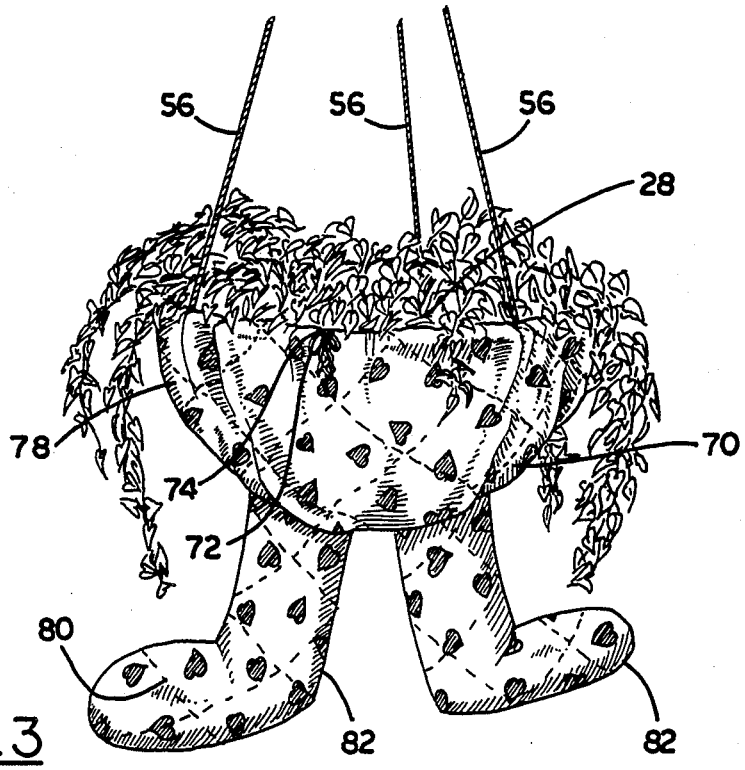
FIG. 3 is a front perspective view of a hanging pot with fully cushioned flower pot cover.

FIG. 3 shows an embodiment in which an occupied item of clothing is characterized in flower pot cover 70. Flower pot cover 70 is held on the pot by elastic tie string 72 which is located within the top of pocket 28 and which exits through reinforced openings 74. When pulled and tied, the string constricts the top of the pocket so that it grips the outside of the pot, thereby holding the cover on the pot. Pants waist area 78 is padded against impact to the pot which represents the trunk of a wearer's body. Quilting stitches 80 hold the padding in place. Legs 82 are packed full with material for cushioning against impact so that they are semirigid, whereby the feet extend horizontally.

Figure 4:
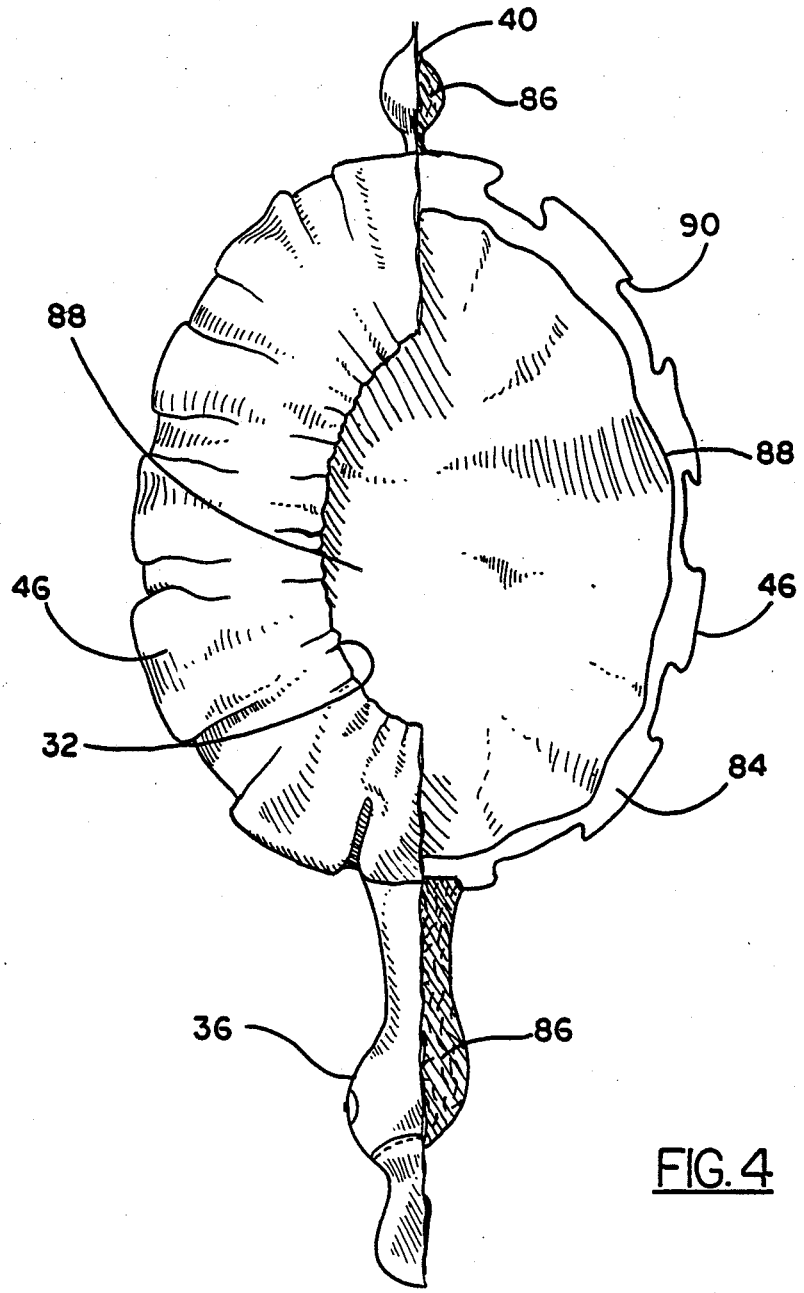
FIG. 4 is a top, partial cross section schematic view of the flower pot cover of FIG. 1. The right side of the figure is in cross section taken along the plane A—A, while the left side is in top perspective view.

In FIG. 4, the flower pot cover shown in FIG. 1 is shown in partial top view, less flower pot, with the right side sectioned at A—A. Material for cushioning against impact 86, which in this cover is cotton batting, but which may be foam rubber, fiberglass or other cushioning material, is included in protuberance 36 which forms the head of the duck. Protuberance 40 also contains material 86 for cushioning against impact.

Inner layer 88 is made from heavy gauge flexible plastic, such as vinyl. It is formed in a pocket with seamless bottom so that it is sealed against leakage of water from the cover. It extends upward with gathers 90 around the side, so that a loose fit is established around the pot. The top of the inner layer extends over the top of the pot where the inner layer, drawn inward by a built-in elastic, rests on the upper rim of the pot (not shown). The waterproof bag thus formed, holds in moisture that otherwise would be lost through the sides of a clay pot. It also prevents leakage from the overflow opening normally found at the bottom of a plant pot from leaking from the pot on to furniture or a floor. The inner waterproof layer permits resting the flower pot with cover on a stand or furniture without concern about water damage from the pot.

Outer layer 46 is formed with gathers so that a loose fit is established between it and the inner layer, which leaves air spaces 84 between the outer layer and the inner layer. This reduces clinging to the inner layer, even when the outer layer is wet, and facilitates faster drying of the outer layer and outer surface of the inner layer to avoid mildew. Although the inner layer is seamless at the bottom of the pocket, the outer layer there is stitched, along the bottom of the cover, where it is joined with protuberance 38 as shown in FIG. 1. At the top of the cover, outer layer 46 is joined 32 to inner layer 88, as shown in FIGS. 1 and 4.

The cover cushioned protrusion design is not limited to a barnyard animal, but may be mythical animal, famous person, football, automobile or other imaginative item. The cover may be held on the pot by other means than elastic, such as belt or clip.

While the preferred embodiment of the invention has been shown and described, it will be understood that the invention may be embodied otherwise than as herein specifically illustrated or described, and that certain changes in form and arrangement of parts, and in the specific manner of practicing the invention may be made without departing from the underlying idea or principles of this invention within the scope of the appended claims.

I claim:

1. A cover for a flower pot, said cover comprising:

a first, inner layer comprising a flexible waterproof material, and a second, outer layer comprising a flexible material, said first layer further comprising:

a first pocket having a bottom and a top, the top being open for receiving the flower pot, the bottom being sealed against leakage of water from the cover, the pocket being large enough to loosely enclose the pot.

said second layer comprising a second pocket generally enclosing the inner layer and further comprising a water permeable material, said second pocket being large enough to loosely enclose the first pocket, and said second layer further comprising:

a protuberance, said protuberance comprising material for cushioning against impact and said protuberance comprising a decorative form of an animal, and means for reducing the size of the top opening of the pocket for securing the cover on the pot.

an item of apparel, removably attached to the protuberance for entrainment of an observer.

2. A cover from a flower pot, said cover comprising:

a first, inner layer comprising a flexible waterproof material, and a second, outer layer comprising a flexible material, said first layer further comprising:

a first pocket having a bottom and a top, the top being open for receiving the flower pot, the bottom being sealed against leakage of water from the cover, the pocket being large enough to loosely enclose the pot, said second layer comprising a water permeable material defining a second pocket generally enclosing the inner layer and further defining a decorative form of, a portion of an animal including a trunk and a body extremity of said animal, said second pocket of said second layer defining said trunk of said animal, and said second layer extending from said trunk and defining said body extremity, material for cushioning against impact, included between said first and second layer in said extremity so that said extremity is a semi rigid cushioned protuberance, means for reducing the size of the top opening of the pocket for securing the cover on the pot.

* * * * *

UNITED STATES PATENT AND TRADEMARK OFFICE

CERTIFICATE OF CORRECTION

PATENT NO. : 4,914,860

DATED : April 10, 1990

INVENTOR(S) : Michael-Anne Richardson

It is certified that error appears in the above-identified patent and that said Letters Patent is hereby corrected as shown below:

In claim 1:
column 6, line 24 of the patent, change the period after "pot" to a comma --,--
column 6, line 35 of the patent, change the period after "pot" to a comma --,--

In claim 2:
column 6, line 38 of the patent, change "from" to --for-- column 4, line 52 of the patent, delete "in a horizontal"

Signed and Sealed this

Second Day of July, 1991

*Attest:*

*Attesting Officer*

HARRY F. MANBECK, JR.

*Commissioner of Patents and Trademarks*